US009865131B2

(12) United States Patent
Fujisawa et al.

(10) Patent No.: US 9,865,131 B2
(45) Date of Patent: Jan. 9, 2018

(54) GAMING MACHINE HAVING A FIRST DISPLAY AND A SECOND DISPLAY

(71) Applicants: Universal Entertainment Corporation, Tokyo (JP); Aruze Gaming America, Inc., Las Vegas, NV (US)

(72) Inventors: Masumi Fujisawa, Tokyo (JP); Kenta Kitamura, Tokyo (JP); Kensaku Yoshikawa, Tokyo (JP); Susumu Mio, Tokyo (JP); Kazuo Okada, Tokyo (JP)

(73) Assignees: UNIVERSAL ENTERTAINMENT CORPORATION, Tokyo (JP); ARUZE GAMING AMERICA, INC., Las Vegas, NV (US)

( * ) Notice: Subject to any disclaimer, the term of this patent is extended or adjusted under 35 U.S.C. 154(b) by 342 days.

(21) Appl. No.: 14/182,388

(22) Filed: Feb. 18, 2014

(65) Prior Publication Data

US 2014/0274293 A1 Sep. 18, 2014

(30) Foreign Application Priority Data

Mar. 13, 2013 (JP) ..... 2013-050193

(51) Int. Cl.
*G07F 17/34* (2006.01)
*G07F 17/32* (2006.01)

(52) U.S. Cl.
CPC ..... *G07F 17/3258* (2013.01); *G07F 17/34* (2013.01)

(58) Field of Classification Search
CPC ... G07F 17/3258; G07F 17/34; G07F 17/3244
See application file for complete search history.

(56) References Cited

U.S. PATENT DOCUMENTS 6,612,927 B1 * 9/2003 Slomiany ..... G07F 17/3244 463/13
7,294,058 B1 * 11/2007 Slomiany ..... G07F 17/32 463/31
8,075,389 B1 * 12/2011 Schultz ..... G07F 17/3244 463/16
2003/0195034 A1 * 10/2003 Dunaevsky ..... G07F 17/34 463/20

(Continued)

FOREIGN PATENT DOCUMENTS

CN 102810232 12/2012
JP 2007-020954 2/2007

OTHER PUBLICATIONS

The Office Action, Macau International Intellectual Property Office, dated May 14, 2015, Macau Application No. I/1268.

*Primary Examiner* — James S McClellan
*Assistant Examiner* — Syvila Weatherford
(74) *Attorney, Agent, or Firm* — Lex IP Meister, PLLC

(57) ABSTRACT

Provided is a gaming machine that can offer various play patterns and payout patterns without giving the player distrust or uncomfortableness. Upon establishment of a bonus trigger, a main CPU conducts a jackpot challenge lottery; if a jackpot is drawn, conducts another lottery to select either one of the prizes, Credit or Jackpot+Credit; if the prize Credit is drawn, pays out a determined amount to be credited; if the prize Jackpot+Credit is drawn, conducts another lottery for a jackpot prize, and pays out the amount corresponding to the drawn prize and the amount to be credited.

5 Claims, 14 Drawing Sheets

(56) References Cited

U.S. PATENT DOCUMENTS

| | | | | |
|---|---|---|---|---|
| 2006/0121971 | A1* | 6/2006 | Slomiany | G07F 17/32 463/16 |
| 2007/0218982 | A1* | 9/2007 | Baerlocher | G07F 17/32 463/27 |
| 2009/0215523 | A1* | 8/2009 | Acres | G07F 17/32 463/20 |
| 2011/0059788 | A1* | 3/2011 | Itagaki | G07F 17/3244 463/20 |
| 2011/0207523 | A1* | 8/2011 | Filipour | G07F 17/32 463/25 |
| 2012/0214575 | A1* | 8/2012 | Amaitis | G06Q 50/34 463/25 |
| 2012/0309487 | A1 | 12/2012 | Yoshikawa | |
| 2013/0274011 | A1* | 10/2013 | Meyer | G07F 17/3267 463/31 |

* cited by examiner

FIG. 4

| | FIRST VIDEO REEL | SECOND VIDEO REEL | THIRD VIDEO REEL | FOURTH VIDEO REEL | FIFTH VIDEO REEL |
|---|---|---|---|---|---|
| CODE NUMBER | SYMBOL | SYMBOL | SYMBOL | SYMBOL | SYMBOL |
| 00 | CHERRY | ORANGE | APPLE | CHERRY | ORANGE |
| 01 | PLUM | BELL | CHERRY | ORANGE | APPLE |
| 02 | ORANGE | APPLE | ORANGE | PLUM | ORANGE |
| 03 | PLUM | BELL | APPLE | STRAWBERRY | BELL |
| 04 | ORANGE | CHERRY | ORANGE | BELL | PLUM |
| 05 | PLUM | ORANGE | PLUM | PLUM | BLUE 7 |
| 06 | ORANGE | PLUM | ORANGE | APPLE | ORANGE |
| 07 | PLUM | CHERRY | PLUM | BLUE 7 | APPLE |
| 08 | BLUE 7 | BELL | ORANGE | PLUM | PLUM |
| 09 | CHERRY | APPLE | PLUM | ORANGE | BELL |
| 10 | ORANGE | BELL | ORANGE | BELL | CHERRY |
| 11 | BELL | STRAWBERRY | PLUM | ORANGE | PLUM |
| 12 | ORANGE | PLUM | BELL | PLUM | BELL |
| 13 | STRAWBERRY | BLUE 7 | STRAWBERRY | CHERRY | ORANGE |
| 14 | BLUE 7 | BELL | BLUE 7 | APPLE | APPLE |
| 15 | ORANGE | APPLE | BELL | STRAWBERRY | PLUM |
| 16 | APPLE | BELL | CHERRY | CHERRY | CHERRY |
| 17 | PLUM | STRAWBERRY | PLUM | BELL | ORANGE |
| 18 | ORANGE | PLUM | ORANGE | PLUM | BELL |
| 19 | PLUM | CHERRY | PLUM | ORANGE | ORANGE |
| 20 | BLUE 7 | BELL | ORANGE | CHERRY | PLUM |
| 21 | CHERRY | APPLE | PLUM | PLUM | STRAWBERRY |

FIG. 6

SYMBOL COMBINATION TABLE

| COMBINATION OF SYMBOLS | | | | | NUMBER OF PAYOUTS | WINNING COMBINATION |
|---|---|---|---|---|---|---|
| FIRST VIDEO REEL | SECOND VIDEO REEL | THIRD VIDEO REEL | FOURTH VIDEO REEL | FIFTH VIDEO REEL | | |
| APPLE | APPLE | APPLE | (ANY) | (ANY) | BONUS GAME | BONUS GAME TRIGGER |
| APPLE | APPLE | APPLE | APPLE | (ANY) | BONUS GAME | BONUS GAME TRIGGER |
| APPLE | APPLE | APPLE | APPLE | APPLE | BONUS GAME | BONUS GAME TRIGGER |
| BLUE 7 | BLUE 7 | BLUE 7 | BLUE 7 | BLUE 7 | 10 | BLUE |
| BELL | BELL | BELL | BELL | BELL | 8 | BELL |
| CHERRY | CHERRY | CHERRY | CHERRY | CHERRY | 5 | CHERRY3 |
| STRAWBERRY | STRAWBERRY | STRAWBERRY | STRAWBERRY | STRAWBERRY | 5 | STRAWBERRY |
| PLUM | PLUM | PLUM | PLUM | PLUM | 4 | PLUM |
| ORANGE | ORANGE | ORANGE | ORANGE | ORANGE | 3 | ORANGE3 |
| CHERRY | CHERRY | CHERRY | (ANY) | (ANY) | 2 | CHERRY2 |
| ORANGE | ORANGE | ORANGE | (ANY) | (ANY) | 2 | ORANGE2 |
| CHERRY | (ANY) | (ANY) | (ANY) | (ANY) | 1 | CHERRY1 |
| ORANGE | (ANY) | (ANY) | (ANY) | (ANY) | 1 | ORANGE1 |

FIG. 14

JACKPOT CHALLENGE LOTTERY TABLE

| No. | GAME | PROBABILITY |
|---|---|---|
| 0 | FREE GAME A | 1/5 |
| 1 | FREE GAME B | 1/5 |
| 2 | FREE GAME C | 1/5 |
| 3 | FREE GAME D | 1/5 |
| 4 | JACKPOT CHALLENGE | 1/5 |

FIG. 15

CREDIT LOTTERY TABLE

| No. | VALUE | PROBABILITY |
|---|---|---|
| 0 | 18 | 1/7 |
| 1 | 19 | 2/7 |
| 2 | 20 | 2/7 |
| 3 | 21 | 1/7 |
| 4 | 22 | 1/7 |

FIG. 16

JACKPOT LOTTERY TABLE

| No. | CREDIT / JACKPOT + CREDIT | PROBABILITY |
|---|---|---|
| 0 | CREDIT | (X − 1 x THE NUMBER OF BETS) / X |
| 1 | JACKPOT + CREDIT | (1 x THE NUMBER OF BETS) / X |

X = 500 x JACKPOT INITIAL CREDIT (GRAND) / 50000

FIG. 17

JACKPOT LEVEL LOTTERY TABLE

| No. | LEVEL | PROBABILITY |
|---|---|---|
| 0 | MINI | 43/100 |
| 1 | MINOR | 42/100 |
| 2 | MAJOR | 11/100 |
| 3 | GRAND | 4/100 |

GAMING MACHINE HAVING A FIRST DISPLAY AND A SECOND DISPLAY

CROSS-REFERENCE TO RELATED APPLICATIONS

This application claims priority of Japanese Patent Application No. 2013-050193 filed on Mar. 13, 2013. The contents of this application are incorporated herein by reference in their entirety.

BACKGROUND OF THE INVENTION

Technical Field

The present invention relates to a gaming machine that can repetitively conduct a unit game.

Background Art

A traditionally known gaming machine performs as follows: in response to insertion of a play medium such as a coin and press of the spin button by a player, extracts a random number for symbol determination; determines the symbols to be displayed to the player when a plurality of video reels on the display are stopped; starts scrolling the symbol arrays on the video reels; stops the scrolling to rearrange the symbols so that the determined symbols are displayed to the player; determines whether or not the displayed combination of symbols corresponds to a prize; and, if it corresponds to a prize, provides the player with a benefit for the pattern of the combination of symbols.

Such a gaming machine determines and sets the number of payouts payable during a bonus game in response to a BB (big bonus) win that triggers the bonus (for example, refer to Japanese unexamined patent application publication No. 2007-20954). This gaming machine offers a bonus game until the player fully receives the set number of payouts. Such a bonus game includes a roulette game that spins and subsequently stops a roulette wheel on the display, and provides the player with an award for the prize associated with the indication section stopped at a specified position.

SUMMARY OF THE INVENTION

In the foregoing roulette game, however, the probabilities to draw the associated prizes are not equal among a plurality of indication sections (sectorial sections) disposed on the roulette wheel, although these sections have the same size. Accordingly, players may feel distrust or uncomfortableness.

Furthermore, after BB winning of a bonus trigger, this gaming machine merely continues the bonus game until the determined number of medals are paid out. Accordingly, the gaming machine cannot offer various play patterns or payout patterns to the player in the bonus game because the player merely consumes the predetermined number of payouts payable during the bonus game.

Accordingly, an object of the present invention is to provide a gaming machine for a game such as a roulette game that, when multiple indication sections are rearranged, determines to give a prize associated with an indication section at a specified position; the gaming machine is configured so that if indication sections have substantially the same size, the player will draw any one of the prizes correspondingly associated with the indication sections at an equal probability, eliminating the player's distrust or uncomfortableness.

Another object of the present invention is to provide a gaming machine that can offer various play patterns and payout patterns in a bonus game, eliminating monotonousness.

According to an embodiment of the present invention, provided is a gaming machine comprising a first display (e.g. a display provided by the lower image display panel 141) for displaying a first game which provides a game result based on a plurality of rearranged symbols (e.g. a game such that, if the combination of the symbols shown to the player corresponds to a prize, the game provides the player with a benefit corresponding to the kind of the symbol combination), a second display (e.g. a display provided by the upper image display panel 131) for displaying a second game (e.g. a roulette game) and a third game (e.g. a jackpot game), and a controller (e.g. a main CPU 71, a body PCB 110, and a graphic board 130) for controlling the first display and the second display; the controller is programmed to execute the following processing of (1-1) to (1-6).

The processing of (1-1) is displaying the second game on the second display to show indication sections correspondingly associated with lottery results (e.g. a jackpot challenge section 211 and free game sections 212 to 215) of a first lottery (e.g. a lottery provided by a jackpot challenge lottery table) to have a substantially equal size in a case where a predetermined number or more of a predetermined type of symbols are rearranged along a winning line on the first display (e.g. in a case where at least three symbols of "APPLE" are displayed along a winning line) as a result of the first game. The processing of (1-2) is conducting the first lottery in which all probabilities to draw the lottery results are assigned to be equal and the processing of (1-3) is displaying the third game on the second display in a case where, after the processing of (1-1), the first lottery results in a predetermined lottery result (e.g. jackpot challenge).

Furthermore, the processing of (1-4) is conducting, after the processing of (1-2), a second lottery (e.g. a lottery provided by a jackpot lottery table) in which probabilities to draw lottery results are assigned to be different from one another; the processing of (1-5) is determining an amount of first payout (e.g. the amount to be credited corresponding to drawing Credit) to be included in a benefit provided to the player in a case where the second lottery results in a first lottery result (e.g. Credit) or a second lottery result (e.g. Jackpot+Credit); and the processing of (1-6) is determining an amount of second payout (e.g. awards for individual jackpot levels) for a lottery result of a third lottery (e.g. a lottery provided by a jackpot level lottery table) to be included in the benefit provided to the player in a case where the second lottery results in the second lottery result (e.g. Jackpot+Credit). It should be noted that the processing of (1-1) and (1-2) can be started at any occasion.

The gaming machine according to the aforementioned embodiment provides the first lottery in the second game in which the indication sections correspondingly associated with lottery results of the first lottery are shown to have the substantially equal size. In the first lottery, all probabilities to draw prizes are assigned to be equal; accordingly, the player will not feel distrust or uncomfortableness.

Furthermore, this gaming machine displays the second game after the first game, displays the third game depending on the result of the first lottery, further conducts the second lottery in the third game, conducts the third lottery depending on the result of the second lottery, and determines the amount of payout depending on the results of these lotteries. In this way, the player is provided with various play patterns and various payout patterns.

According to another embodiment of the present invention, a gaming machine is provided in which the probabilities to draw lottery results in the second lottery are assigned so as to vary in accordance with a number of BETs specified by the player. Such a configuration of the present invention achieves more various play patterns and payout patterns.

According to yet another embodiment of the present invention, a gaming machine is provided in which the probabilities to draw lottery results in the second lottery are assigned in such a manner that the probability to draw the second lottery result is higher when the number of BETs is greater. Such a configuration of the present invention achieves more various play patterns and payout patterns since the number of BETx is taken account of to select a play.

According to yet another embodiment of the present invention, a gaming machine is provided in which the processing of (1-5) includes the processing of (1-5-1), determining the amount of the first payout based on a value determined by a fourth lottery (e.g. a lottery provided by a credit lottery table) and the number of BETs. Such a configuration of the present invention achieves more various payout patterns.

According to yet another embodiment of the present invention, a gaming machine is provided in which the third game is configured as a jackpot game; the probabilities to draw lottery results in the second lottery are assigned so as to vary depending on a value of an initial credit for a specified level in the jackpot game; and the amount of the second payout is determined to be an amount obtained by accumulating a predetermined percentage of an amount corresponding to the number of BETs when the jackpot game is repeated. Such a configuration of the present invention achieves more various play patterns and payout patterns since the initial credit is taken account of to select a play and the amount of the second payout is determined from the jackpot amount.

According to yet another embodiment of the present invention, a gaming machine is provided in which the probabilities to draw lottery results in the second lottery are assigned in such a manner that the probability to draw the first lottery result is higher when the amount of initial credit is larger. Such a configuration of the present invention achieves more various play patterns since the initial credit is taken account of to select a play and further, secures a proper amount of payout by lowering the winning probability of the jackpot, which is favorable to the player in terms of payout.

A bonus game including various play patterns and payout patterns is provided, eliminating monotonousness. The bonus game is configured for the player to win one of the prizes associated with equally-sized indication sections at the equal probability.

BRIEF DESCRIPTION OF THE DRAWINGS

FIG. 4 is a view illustrating arrangement of symbols that are drawn on the peripheral surfaces of the reels of the gaming machine;

FIG. 6 is a view illustrating a symbol combination table of the gaming machine;

FIG. 14 is a view illustrating a jackpot challenge lottery table;

FIG. 15 is a view illustrating a credit lottery table;

FIG. 16 is a view illustrating a jackpot lottery table;

FIG. 17 is a view illustrating a jackpot level lottery table; and

DESCRIPTION OF THE PREFERRED EMBODIMENTS

[Explanation of Function Flow Diagram]

Figure 1:
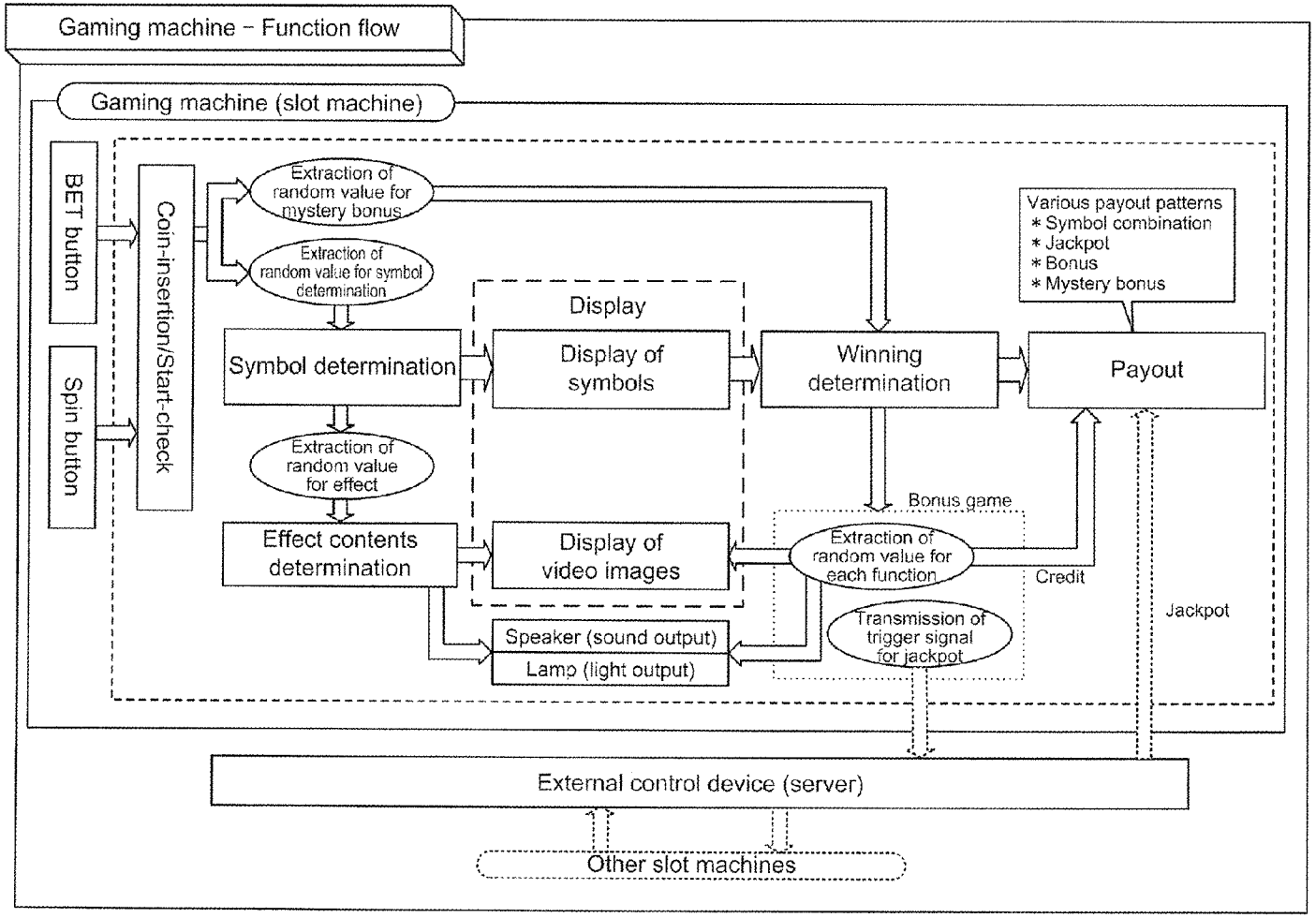
FIG. 1 is a view illustrating a function flow of a gaming machine.

With reference to FIG. 1, basic functions of a gaming machine according to the present embodiment are described. FIG. 1 is a view illustrating a function flow of the gaming machine according to an embodiment of the present invention.

<Coin-Insertion/Start-Check>

First, the gaming machine checks whether or not a BET button has been pressed by a player, and subsequently checks whether or not a spin button has been pressed by the player.

<Symbol Determination>

Next, when the spin button has been pressed by the player, the gaming machine extracts random values for symbol determination, and determines symbols to be displayed at the time of stopping scrolling of symbol arrays for the player, for a plurality of respective video reels displayed to a display.

<Symbol Display>

Next, the gaming machine starts scrolling of the symbol array of each of the video reels and then stops scrolling to rearrange the symbols so that the determined symbols are displayed for the player.

<Winning Determination>

When scrolling of the symbol array of each video reel has been stopped, the gaming machine determines whether or not a combination of symbols displayed for the player is a combination related to winning.

<Payout>

When the combination of symbols displayed for the player is a combination related to winning, the gaming machine offers benefits according to the combination to the player. For example, when a combination of symbols related to a payout of coins has been displayed, the gaming machine pays out coins of the number corresponding to the combination of symbols to the player.

Further, when a combination of symbols related to a bonus game trigger has been displayed, the gaming machine starts a bonus game. It is to be noted that, in the present embodiment, a roulette game, a jackpot game, and a free game are played as a bonus game. The free game is a game in which a lottery relating to the aforementioned determination of to-be stopped symbols is held a predetermined number of times without using coins.

When the player wins a specific level in the foregoing jackpot game, the gaming machine pays out coins from a jackpot amount to the player. The jackpot is a function that accumulates part of the coins used by players in the gaming machine as a jackpot amount and when some player wins a specific jackpot level, pays out an award corresponding to the level. The gaming machine calculates the amount for accumulation in the jackpot amount (namely, a contribution to the jackpot amount) at every play and accumulates it to the jackpot amount.

The jackpot in the gaming machine of the present invention is a standalone type which basically uses a single gaming machine and accumulates part of the coins used in the gaming machine as a jackpot amount but may be a network type which shares a jackpot by gaming machines connected in a single or multiple game facilities and transmits the amounts for accumulation via an external control device.

In the network type, the amount of part of the coins used by the player of each gaming machine is transmitted to the external control device for the jackpot amount, the external control device accumulates the received amounts in the jackpot amount and shares the jackpot amount with the gaming machines. When a player wins a specific jackpot level, the external control device transmits an award corresponding to the jackpot level from the jackpot amount to the gaming machine.

Further, in addition to the aforementioned benefits, the gaming machine is provided with benefits such as a mystery bonus. The mystery bonus is a bonus in which a predetermined amount of coins are paid out for winning of a lottery that is intended for the mystery bonus. When the spin button has been pressed, the gaming machine extracts a random value for mystery bonus and determines whether or not to establish a mystery bonus trigger by lottery.

<Determination of Effects>

The gaming machine produces effects by displaying images to the display, outputting the light from lamps, and outputting sounds from speakers. The gaming machine extracts a random value for effect and determines contents of the effects based on the symbols and the like determined by lottery.

[Overall Game System]

Figure 2:
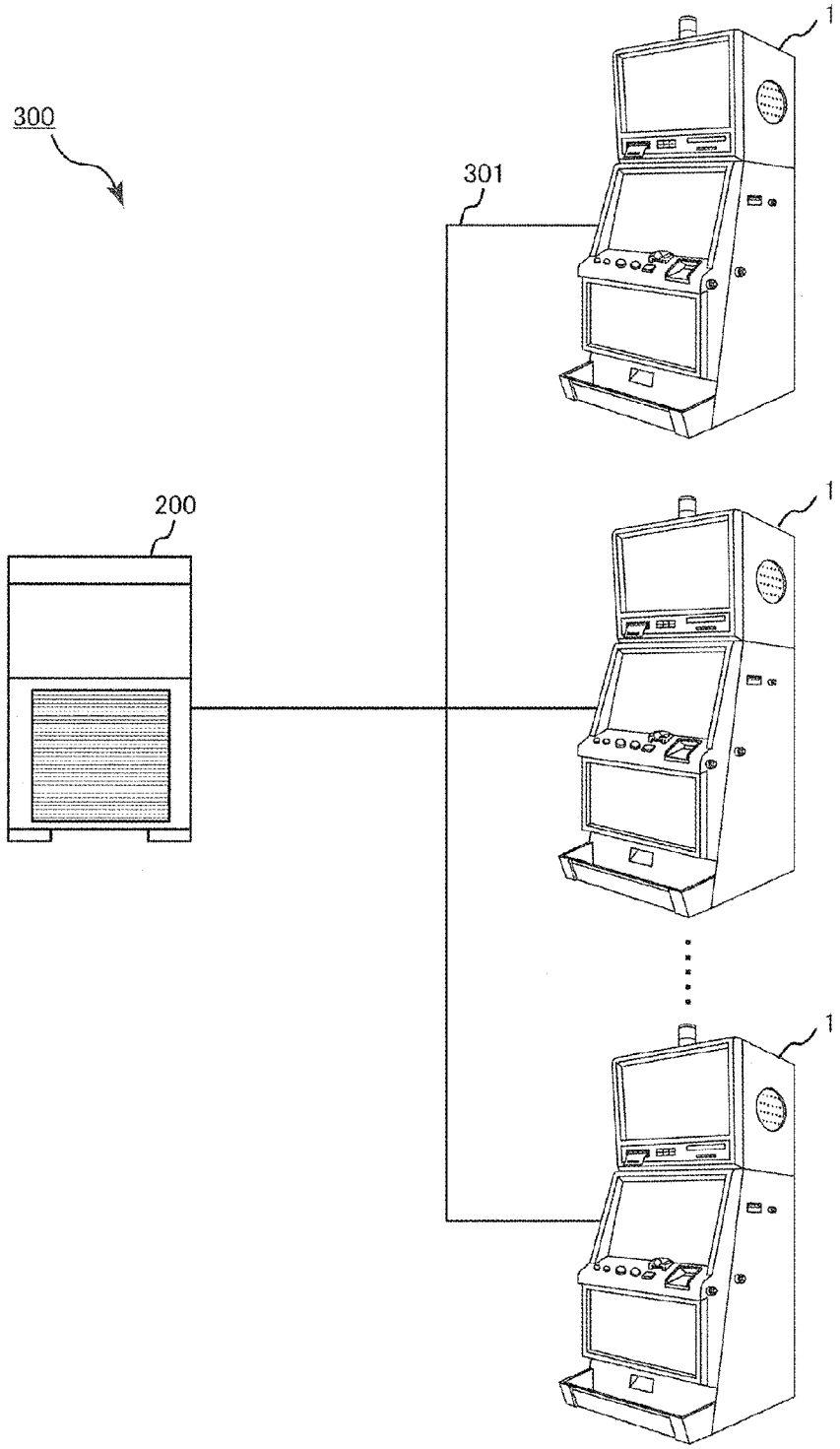
FIG. 2 is a view illustrating a game system including the gaming machine.

The basic functions of the gaming machine have been described above. Next, with reference to FIG. 2, a game system including the gaming machine is described. FIG. 2 is a view illustrating the game system including the gaming machine according to the embodiment of the present invention.

A game system 300 includes a plurality of gaming machines 1, and an external control device 200 that is connected to each of the gaming machines 1 through a communication line 301.

The external control device 200 is for controlling the plurality of gaming machines 1. In the present embodiment, the external control device 200 is a so-called hall server which is installed in a game facility having the plurality of gaming machines 1. Each of the gaming machines 1 is provided with a unique identification number, and the external control device 200 identifies transmission sources of data transmitted from the respective gaming machines 1 by using the identification numbers. Also in the case where the external control device 200 transmits data to a gaming machine 1, the identification numbers are used for specifying the transmission destination.

It is to be noted that the game system 300 may be constructed within a single game facility where various games can be conducted, such as a casino, or may be constructed among a plurality of game facilities. Further, when the game system 300 is constructed in a single game facility, the game system 300 may be constructed in each floor or section of the game facility. The communication line 301 may be a wired or wireless line, and can adopt a dedicated line, an exchange line or the like.

[Overall Configuration of Gaming Machine]

Figure 3:
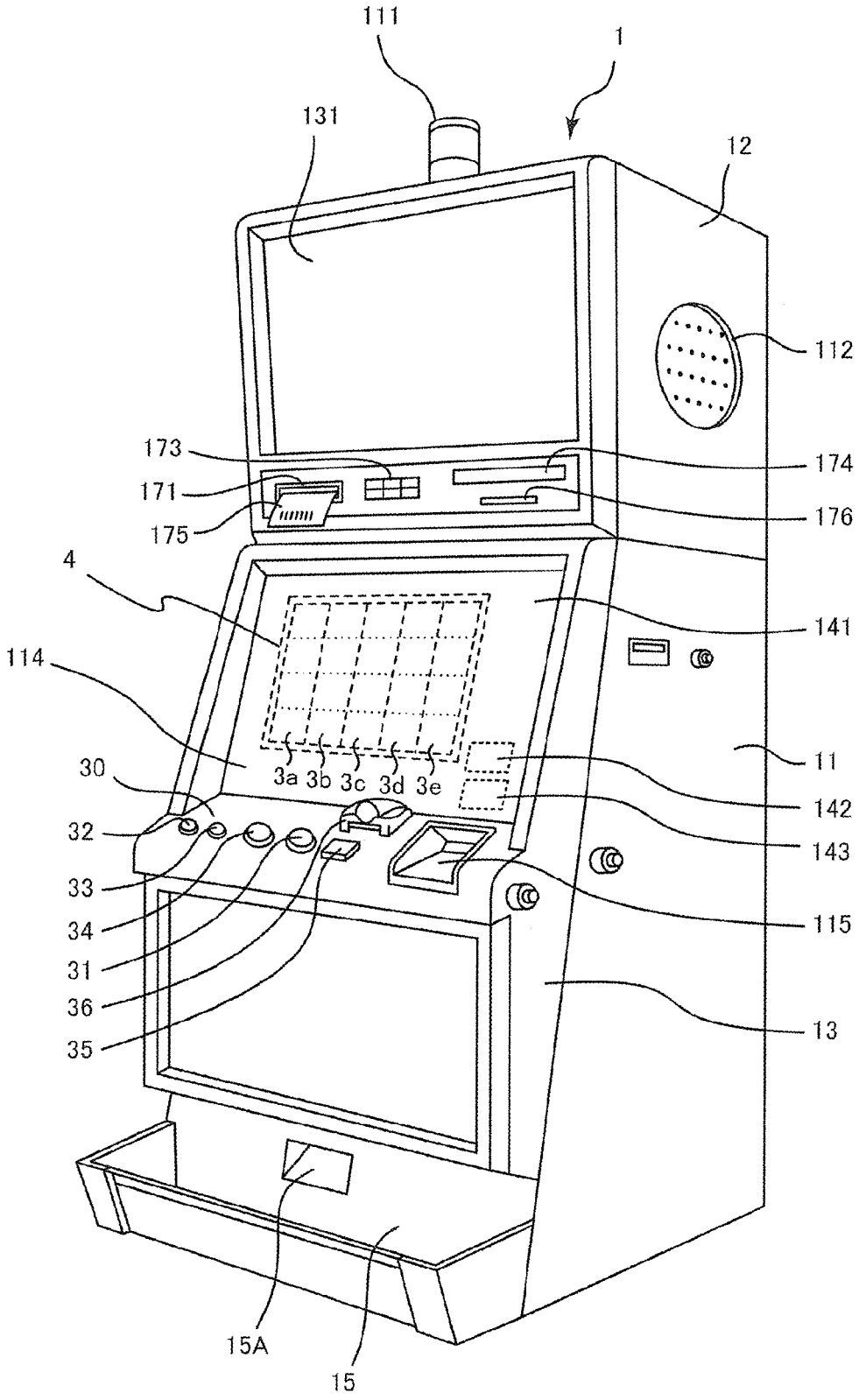
FIG. 3 is a view illustrating an overall configuration of the gaming machine.

The game system according to the present embodiment has been described above. Next, with reference to FIG. 3, an overall configuration of the gaming machine 1 is described. FIG. 3 is a view illustrating the overall configuration of the gaming machine according to the embodiment of the present invention.

A coin, a bill, or electrically valuable information corresponding to these is used as a game medium in the gaming machine 1. Further, in the present embodiment, a later-described ticket with a barcode is also used. It is to be noted that the game medium is not limited to these, and for example a medal, a token, electric money or the like can be adopted.

The gaming machine 1 includes a cabinet 11, a top box 12 installed on the upper side of the cabinet 11, and a main door 13 provided at the front face of the cabinet 11.

A lower image display panel 141 is provided at the center of the main door 13. The lower image display panel 141 includes a liquid crystal panel, and forms the display. The lower image display panel 141 has a symbol display region 4. To the symbol display region 4, five video reels 3 (3*a*, 3*b*, 3*c*, 3*d*, 3*e*) are displayed. In the present embodiment, a video reel depicts through videos the rotational and stop motions of a mechanical reel having a plurality of symbols drawn on the peripheral surface thereof. To each of the video reels 3, a symbol array comprised of a previously determined plurality (22 in the present embodiment) of symbols is assigned (see FIG. 4 which is described later).

In the symbol display region 4, the symbol arrays assigned to the respective video reels 3 are separately scrolled, and are stopped after predetermined time has elapsed. As a result, a part (four consecutive symbols in the present embodiment) of each of the symbol arrays is displayed for the player. The symbol display region 4 has four regions, namely an upper region, an upper central region, a lower central region, and a lower region, for each video reel 3, and a single symbol is to be displayed to each region. That is, 20 (=5 columns×4 symbols) symbols are to be displayed in the symbol display region 4.

In the present embodiment, a line formed by selecting one of the aforementioned four regions for each of the video reels 3 and connecting the respective regions is referred to as a winning line. It is to be noted that any desired shape of the winning line can be adopted, and examples of the shape of the winning line may include a straight line formed by connecting the upper central regions for the respective video reels 3, a V-shaped line, and a bent line. Also, any desired number of lines can be adopted, and the number can be for example 30 lines.

Further, the lower image display panel 141 has a number-of-credits display region 142 and a number-of-payouts display region 143. The number-of-credits display region 142 displays the number of coins (hereinafter also referred to as "the number of credits") owned by the player and retained inside the gaming machine 1. The number-of-payouts display region 143 displays the number of coins (hereinafter also referred to as "the number of payouts") to be paid out to the player when winning is established.

The lower image display panel 141 has a built-in touch panel 114. The player can input various commands by touching the lower image display panel 141.

On the lower side of the lower image display panel 141, there are arranged various buttons set in a control panel 30, and various devices to be operated by the player.

A spin button 31 is used when starting scrolling of the symbol arrays of the respective video reels 3. A change button 32 is used when requesting a game facility staff member to exchange money. A CASHOUT button 33 is used when paying out the coins retained inside the gaming machine 1 to a coin tray 15.

A 1-BET button 34 and a maximum BET button 35 are used for determining the number of coins (hereinafter also referred to as "the number of BETs") to be used in the game from the coins retained inside the gaming machine 1. The 1-BET button 34 is used when determining one coin at a time for the aforementioned number of BETs. The maximum BET button 35 is used when setting the aforementioned number of BETs to a defined upper limit number.

A coin accepting slot 36 is provided to accept coins. A bill validator 115 is provided to accept bills. The bill validator 115 validates a bill, and accepts a valid bill into the cabinet 11. It is to be noted that the bill validator 115 may be configured so as to be capable of reading a later-described ticket 175 with a barcode.

An upper image display panel 131 is provided at the front face of the top box 12. The upper image display panel 131 includes a liquid crystal panel, and forms the display. The upper image display panel 131 displays images related to effects, images of a roulette game, a jackpot game, and a free game, which are related to the later-described bonus game, and images showing introduction of the game contents and explanation of the game rules. Further, the top box 12 is provided with a speaker 112 and a lamp 111. The gaming machine 1 produces effects by displaying images, outputting sounds, and outputting the light.

A ticket printer 171, a card slot 176, a data display 174, and a keypad 173 are provided on the lower side of the upper image display panel 131.

The ticket printer 171 prints on a ticket a barcode representing encoded data of the number of credits, date, the identification number of the gaming machine 1, and the like, and outputs the ticket as the ticket 175 with a barcode. The player can make a gaming machine read the ticket 175 with a barcode so as to play a game thereon, and can also exchange the ticket 175 with a barcode with a bill or the like at a predetermined place (e.g. a cashier in a casino) in the game facility.

The card slot 176 is for inserting a card in which predetermined data is stored. For example, the card stores data for identifying the player, and data about the history of games played by the player. When the card is inserted into the card slot 176, a later-described card reader 172 reads data from the card or writes data into the card. It is to be noted that the card may store data corresponding to a coin, a bill or a credit.

The data display 174 includes a fluorescent display, LEDs and the like, and displays the data read by the card reader 172 or the data inputted by the player via the keypad 173, for example. The keypad 173 is for inputting a command and data related to ticket issuance or the like.

In this description, the gaming machine according to the embodiment of the present invention controls display of the video reels on the display; however, a different type of gaming machine may be employed that drives mechanical reels with stepping motors to display the symbols for the player.

[Symbol Arrays of Video Reels]

The overall configuration of the gaming machine 1 has been described above. Next, with reference to FIG. 4, a configuration of the symbol arrays included in the video reels 3 of the gaming machine 1 is described. FIG. 4 is a view illustrating arrangement of symbols that are drawn on the peripheral surfaces of the reels of the gaming machine according to the embodiment of the present invention.

A first video reel 3*a*, a second video reel 3*b*, a third video reel 3*c*, a fourth video reel 3*d*, and a fifth video reel 3*e* each is assigned with a symbol array consisting of 22 symbols that correspond to respective code numbers from "00" to "21".

Types of the symbols provided are "BLUE 7", "BELL", "CHERRY", "STRAWBERRY", "PLUM", "ORANGE" and "APPLE".

[Configuration of Circuit Included in Gaming Machine]

Figure 5:
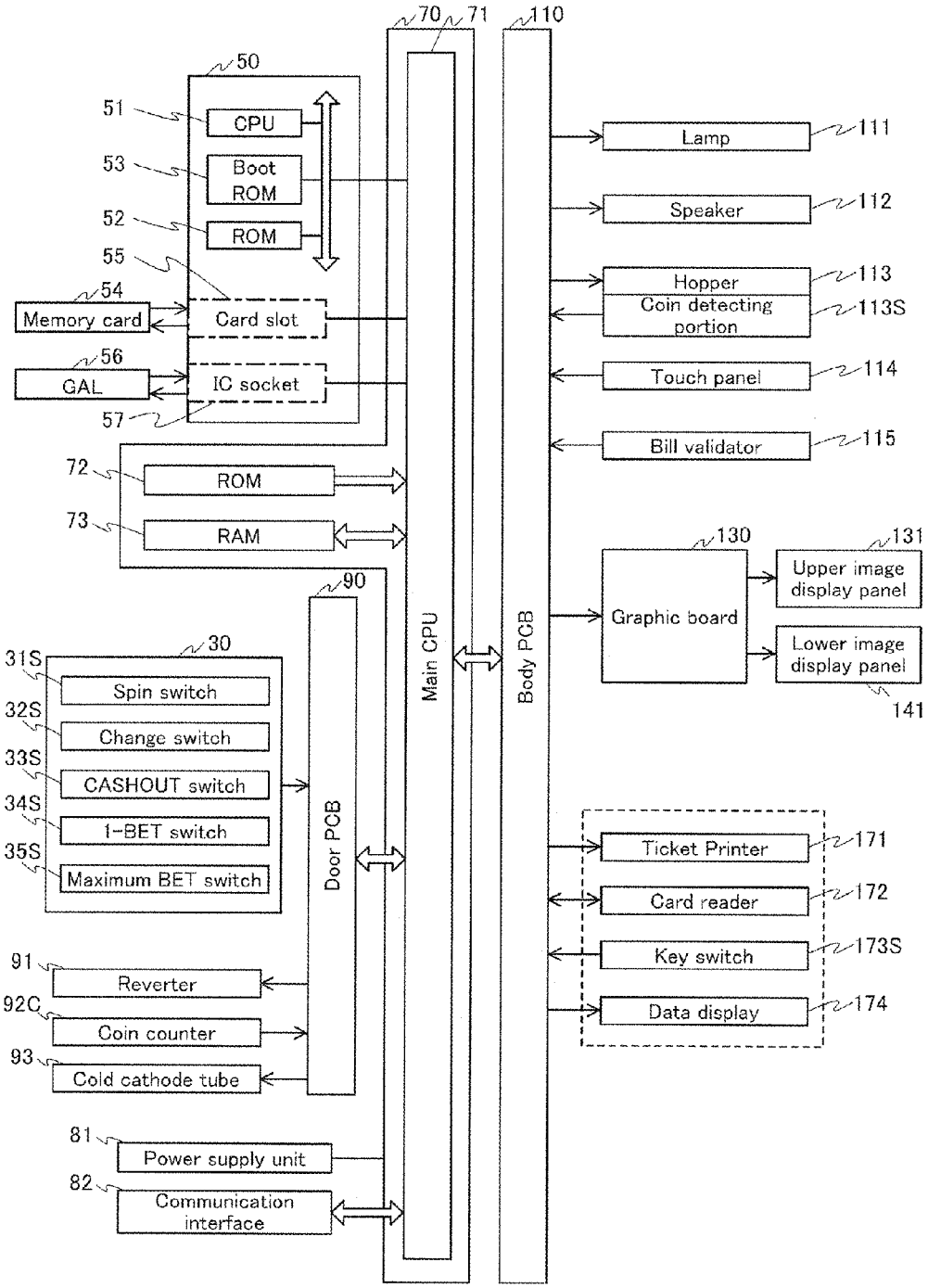
FIG. 5 is a block diagram illustrating an internal configuration of the gaming machine.

The configuration of the symbol arrays included in the video reels 3 of the gaming machine 1 has been described above. Next, with reference to FIG. 5, a configuration of a circuit included in the gaming machine 1 is described. FIG. 5 is a block diagram illustrating an internal configuration of the gaming machine according to the embodiment of the present invention.

A gaming board 50 is provided with: a CPU 51, a ROM 52, and a boot ROM 53, which are mutually connected by an internal bus; a card slot 55 corresponding to a memory card 54; and an IC socket 57 corresponding to a GAL (Generic Array Logic) 56.

The memory card 54 includes a non-volatile memory, and stores a game program and a game system program. The game program includes a program related to game progression, a lottery program, and a program for producing effects by images and sounds (e.g. see FIGS. 7 to 13 which are described later). Further, the aforementioned game program includes data (see FIG. 4) specifying the configuration of the symbol array assigned to each video reel 3.

The lottery program is a program for determining to-be stopped symbol of each video reel 3 by lottery. The to-be stopped symbol is data for determining four symbols to be displayed to the symbol display region 4 out of the 22 symbols forming each symbol array. The gaming machine 1 of the present embodiment determines as the to-be stopped symbol the symbol to be displayed in a predetermined region (e.g. the upper region) out of the four regions provided for each of the video reels 3 of the symbol display region 4.

The aforementioned lottery program includes symbol determination data. The symbol determination data is data that specifies random values so that each of the 22 symbols (code numbers from "00" to "21") forming the symbol array is determined at an equal probability (i.e. 1/22), for each video reel 3. The probabilities of the respective 22 symbols being determined are basically equal. However, the numbers of the respective types of symbols included in the 22 symbols vary, and thus the probabilities of the respective types of symbols being determined vary (i.e. different weights on the probabilities are generated). For example, with reference to FIG. 4, the symbol array of the first video reel 3*a* includes one symbol of "STRAWBERRY", and includes seven symbols of "ORANGE". Hence, the former is determined at the probability of "1/22", whereas the latter is determined at the probability of "7/22".

It is to be noted that, although the data specifies that the equal numbers of symbols be provided to form the symbol arrays of the respective video reels 3 in the present embodiment, different numbers of symbols may form the respective video reels 3. For example, the symbol array of the first video reel 3*a* may consist of 22 symbols whereas the symbol array of the second video reel 3*b* may consist of 30 symbols. Such a configuration increases the degree of freedom in setting the probabilities of the respective types of symbols being determined for each video reel 3.

Further, the card slot 55 is configured so that the memory card 54 can be inserted thereinto and removed therefrom, and is connected to a motherboard 70 by an IDE bus.

The GAL 56 is a type of PLD (Programmable Logic Device) having a fixed OR array structure. The GAL 56 is provided with a plurality of input ports and output ports, and predetermined input into the input port causes output of the corresponding data from the output port.

Further, the IC socket 57 is configured so that the GAL 56 can be inserted thereinto and removed therefrom, and is connected to the motherboard 70 by a PCI bus. The contents of the game to be played on the gaming machine 1 can be changed by replacing the memory card 54 with another memory card 54 having another program written therein or by rewriting the program written into the memory card 54 as another program.

The CPU 51, the ROM 52 and the boot ROM 53 mutually connected by the internal bus are connected to the motherboard 70 by a PCI bus. The PCI bus enables a signal transmission between the motherboard 70 and the gaming board 50, and power supply from the motherboard 70 to the gaming board 50.

The ROM 52 stores an authentication program. The boot ROM 53 stores a pre-authentication program, a program (boot code) to be used by the CPU 51 for activating the pre-authentication program, and the like. The authentication program is a program (tamper check program) for authenticating the game program and the game system program. The pre-authentication program is a program for authenticating the aforementioned authentication program. The authentication program and the pre-authentication program are written along a procedure (authentication procedure) for proving that the program to be the subject has not been tampered.

The motherboard 70 is provided with a main CPU 71, a ROM 72, a RAM 73, and a communication interface 82.

The ROM 72 includes a memory device such as a flash memory, and stores a program such as BIOS to be executed by the main CPU 71, and permanent data. When the BIOS is executed by the main CPU 71, processing for initializing predetermined peripheral devices is conducted; further, through the gaming board 50, processing of loading the game program and the game system program stored in the memory card 54 is started.

The RAM 73 stores data and programs which are used in operation of the main CPU 71. For example, when the processing of loading the aforementioned game program, game system program or authentication program is conducted, the RAM 73 can store the program. The RAM 73 is provided with working areas used for operations in execution of these programs. Examples of the areas include: an area that stores the number of games, the number of BETs, the number of payouts, the number of credits and the like; and an area that stores symbols (code numbers) determined by lottery.

The communication interface 82 is for communicating with the external control device 200 such as a server, through the communication line 301. Further, the motherboard 70 is connected with a later-described door PCB (Printed Circuit Board) 90 and a body PCB 110 by respective USBs. The motherboard 70 is also connected with a power supply unit 81. When the power is supplied from the power supply unit 81 to the motherboard 70, the main CPU 71 of the motherboard 70 is activated, and then the power is supplied to the gaming board 50 through the PCI bus so as to activate the CPU 51.

The door PCB 90 and the body PCB 110 are connected with input devices such as a switch and a sensor, and peripheral devices the operations of which are controlled by the main CPU 71. The door PCB 90 is connected with a control panel 30, a reverter 91, a coin counter 92C and a cold cathode tube 93.

The control panel 30 is provided with a spin switch 31S, a change switch 32S, a CASHOUT switch 33S, a 1-BET switch 34S and a maximum BET switch 35S which correspond to the aforementioned respective buttons. Each of the switches outputs a signal to the main CPU 71 upon detection of press of the button corresponding thereto by the player.

The coin counter 92C validates a coin inserted into the coin accepting slot 36 based on its material, shape and the like, and outputs a signal to the main CPU 71 upon detection of a valid coin. Invalid coins are discharged from a coin payout exit 15A.

The reverter 91 operates based on a control signal outputted from the main CPU 71, and distributes valid coins validated by the coin counter 92C into a hopper 113 or a cash box (not illustrated). That is, coins are distributed into the hopper 113 when the hopper 113 is not filled with coins, while coins are distributed into the cash box when the hopper 113 is filled with coins.

The cold cathode tube 93 functions as a backlight installed on the rear face sides of the upper image display panel 131 and the lower image display panel 141, and lights up based on a control signal outputted from the main CPU 71.

The body PCB 110 is connected with the lamp 111, the speaker 112, the hopper 113, a coin detecting portion 113S, the touch panel 114, the bill validator 115, a graphic board 130, the ticket printer 171, the card reader 172, a key switch 173S and the data display 174.

The lamp 111 lights up based on a control signal outputted from the main CPU 71. The speaker 112 outputs sounds such as BGM, based on a control signal outputted from the main CPU 71.

The hopper 113 operates based on a control signal outputted from the main CPU 71, and pays out coins of the specified number of payouts from the coin payout exit 15A to the coin tray 15. The coin detecting portion 113S outputs a signal to the main CPU 71 upon detection of coins paid out by the hopper 113.

The touch panel 114 detects a place on the lower image display panel touched by the player's finger or the like, and outputs to the main CPU 71 a signal corresponding to the detected place. In similar, the upper image display panel 131 may be made of a touch panel. Upon acceptance of a valid bill, the bill validator 115 outputs to the main CPU 71 a signal corresponding to the face amount of the bill.

The graphic board 130 controls display of images conducted by the respective upper image display panel 131 and lower image display panel 141, based on a control signal outputted from the main CPU 71. The symbol display region 4 of the lower image display panel 141 displays the five video reels 3 by which the scrolling and stop motions of the symbol arrays included in the respective video reels 3 are displayed. The graphic board 130 is provided with a VDP generating image data, a video RAM temporarily storing the image data generated by the VDP, and the like. The number-of-credits display region 142 of the lower image display panel 141 displays the number of credits stored in the RAM 73. The number-of-payouts display region 143 of the lower image display panel 141 displays the number of payouts of coins.

The graphic board 130 is provided with the VDP (Video Display Processor) generating image data based on a control signal outputted from the main CPU 71, the video RAM temporarily storing the image data generated by the VDP, and the like. It is to be noted that the image data used in generation of image data by the VDP is included in the game program that has been read from the memory card 54 and stored into the RAM 73.

Based on a control signal outputted from the main CPU 71, the ticket printer 171 prints on a ticket a barcode representing encoded data of the number of credits stored in the RAM 73, date, the identification number of the gaming machine 1, and the like, and then outputs the ticket as the ticket 175 with a barcode.

The card reader 172 reads data stored in a card inserted into the card slot 176 and transmits the data to the main CPU 71, or writes data into the card based on a control signal outputted from the main CPU 71.

The key switch 173S is provided in the keypad 173, and outputs a predetermined signal to the main CPU 71 when the keypad 173 has been operated by the player.

The data display 174 displays data read by the card reader 172 and data inputted by the player through the keypad 173, based on a control signal outputted from the main CPU 71.

[Configuration of Symbol Combination Table]

The circuit configuration of the gaming machine 1 has been described above. Next, with reference to FIG. 6, a symbol combination table is described. FIG. 6 is a view illustrating a symbol combination table of the gaming machine according to the embodiment of the present invention.

The symbol combination table specifies combinations of drawn symbols relating to winning, and the number of payouts. On the gaming machine 1, the scrolling of symbol arrays of the respective video reels 3 is stopped, and winning is established when the combination of symbols displayed along the winning line matches one of the combinations of symbols specified by the symbol combination table. According to the winning combination, a benefit such as payout of coins or start of a bonus game is offered to the player. It is to be noted that winning is not established (i.e. the game is lost) when the combination of symbols displayed along the winning line does not match any of the combinations of symbols specified by the symbol combination table.

Basically, winning is established when all symbols displayed along the winning line by the respective video reels 3 are of one type out of "BLUE 7", "BELL", "CHERRY", "STRAWBERRY", "PLUM" and "ORANGE". However, with respect to the respective types of symbols of "CHERRY" and "ORANGE", winning is also established when one or three symbols of either type are displayed along the winning line by the video reels 3. For example, when all the symbols displayed along the winning line by all the video reels 3 are "BLUE 7", the winning combination is "BLUE", and "10" is determined as the number of payouts. Based on the determined number of payouts, payout of coins is conducted. The payout of coins is conducted by actually discharging coins from the coin payout exit 15A or adding the determined number of payouts to the number of credits, or issuing a ticket with a barcode.

The symbol type "APPLE" relates to a bonus game trigger and referred to as bonus symbol. When bonus symbols of "APPLE" are displayed along the winning line by at least three video reels 3, the winning combination is a "bonus game trigger" and a bonus game starts from the next play.

In the symbol combination table, patterns including three, four, and five symbols of "APPLE" are indicated as "bonus game triggers". However, with respect to the patterns including three and four symbols, winning is established when three or four symbols are displayed along the winning line by the video reels 3; there is no requirement for these symbols to be displayed by specified video reels. This is the same as the aforementioned case where one or three symbols of either "CHERRY" or "ORANGE" are displayed along the winning line.

[Contents of Program]

The symbol combination table has been described above. Next, with reference to FIGS. 7 to 13, the program to be executed by the gaming machine 1 is described.

<Main Control Processing>

Figure 7:
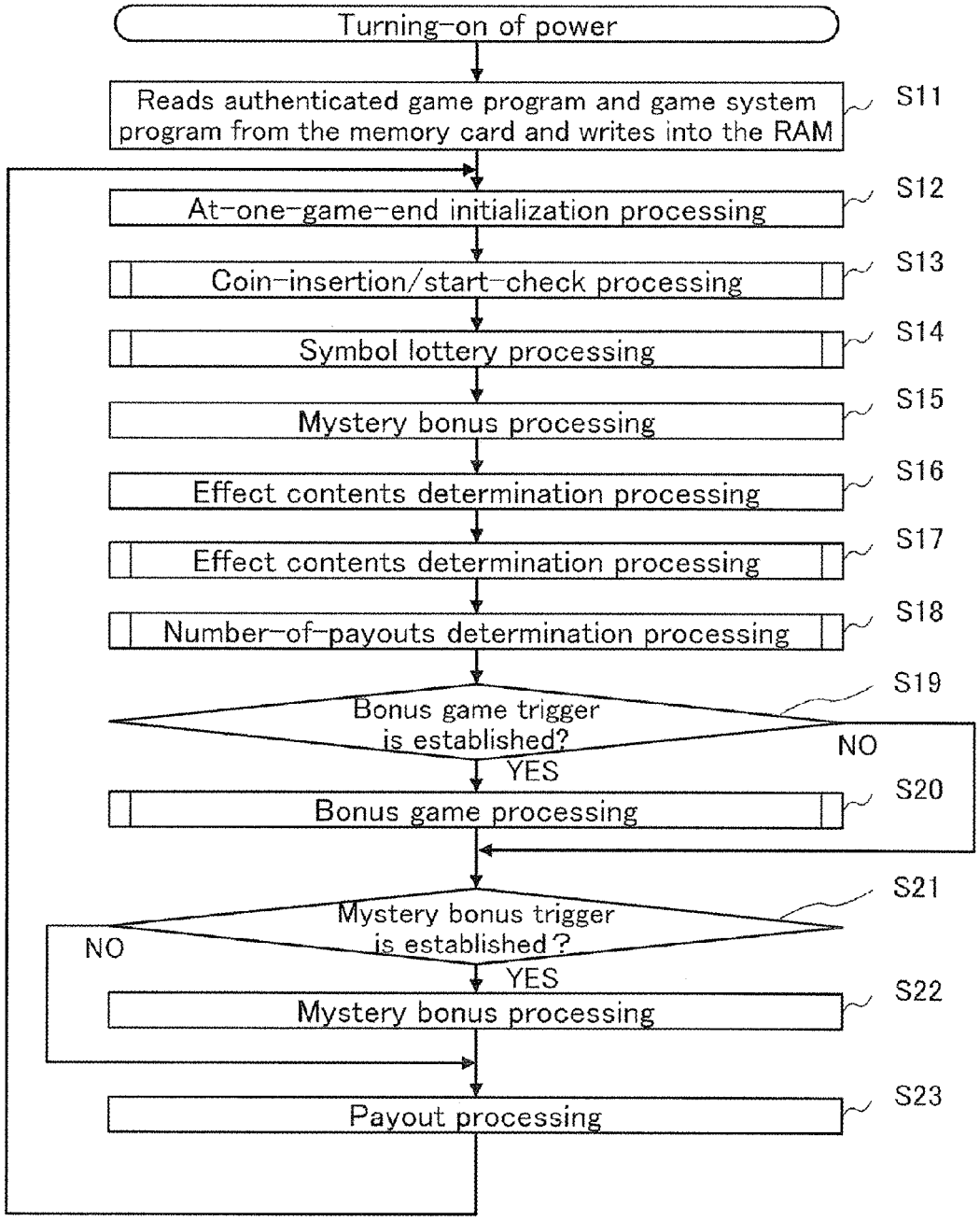
FIG. 7 is a view illustrating a flowchart of main control processing for the gaming machine

First, with reference to FIG. 7, main control processing is described. FIG. 7 is a view illustrating a flowchart of the main control processing for the gaming machine according to the embodiment of the present invention.

First, when the power is supplied to the gaming machine 1, the main CPU 71 reads the authenticated game program and game system program from the memory card 54 through the gaming board 50, and writes the programs into the RAM 73 (step S11).

Next, the main CPU 71 conducts at-one-game-end initialization processing (step S12). For example, data that becomes unnecessary after each game in the working areas of the RAM 73, such as the number of BETs and the symbols determined by lottery, is cleared.

The main CPU 71 conducts coin-insertion/start-check processing which is described later with reference to FIG. 8 (step S13). In the processing, input from the BET switch and the spin switch is checked.

The main CPU 71 then conducts symbol lottery processing which is described later with reference to FIG. 10 (step S14). In the processing, to-be stopped symbols are determined based on the random values for symbol determination.

Next, the main CPU 71 conducts mystery bonus lottery processing (step S15). In the processing, lottery determining whether or not to establish a mystery bonus trigger is held. For example, the main CPU 71 extracts a random value for mystery bonus from the numbers in a range of "0 to 99", and establishes the mystery bonus trigger when the extracted random value is "0".

The main CPU 71 conducts effect contents determination processing (step S16). The main CPU 71 extracts a random value for effect, and determines any of the effect contents from the preset plurality of effect contents by lottery.

The main CPU 71 then conducts symbol display control processing which is described later with reference to FIG. 11 (step S17). In the processing, scrolling of the symbol array of each video reel 3 is started, and the to-be stopped symbol determined in the symbol lottery processing of step S14 is stopped at a predetermined position (e.g. the upper region in the symbol display region 4). That is, four symbols including the to-be stopped symbol are displayed in the symbol display region 4. For example, when the to-be stopped symbol is the symbol associated with the code number of "10" and it is to be displayed to the upper region, the symbols associated with the respective code numbers of "11", "12" and "13" are to be displayed to the respective upper central region, lower central region and lower region in the symbol display region 4.

Next, the main CPU 71 conducts number-of-payouts determination processing which is described later with reference to FIG. 12 (step S18). In the processing, the number of payouts is determined based on the combination of symbols displayed along the winning line, and is stored into a number-of-payouts storage area provided in the RAM 73. It should be noted that the number-of-payouts determination processing in bonus game processing is conducted separately in the bonus game processing, which is described later with reference to FIG. 13.

The main CPU 71 then determines whether or not the bonus game trigger has been established (step S19). When the main CPU 71 determines that the bonus game trigger has been established (for example, when bonus symbols "APPLE" are displayed along a winning line by at least three video reels 3), the main CPU 71 conducts bonus game processing which is described later with reference to FIG. 13 (step S20).

After the processing of step S20 or when determining in step S19 that the bonus game trigger has not been established, the main CPU 71 determines whether or not the mystery bonus trigger is established (step S21). When determining that the mystery bonus trigger has been established, the main CPU 71 conducts the mystery bonus processing (step S22). In the processing, the number of payouts (e.g. 300) being set for the mystery bonus is stored into the number-of-payouts storage area provided in the RAM 73.

The main CPU 71 conducts payout processing (step S23). The main CPU 71 adds the value stored in the number-of-payouts storage area to a value stored in a number-of-credits storage area provided in the RAM 73. It is to be noted that operations of the hopper 113 may be controlled based on input from the CASHOUT switch 33S, and coins of the number corresponding to the value stored in the number-of-payouts storage area may be discharged from the coin payout exit 15A. Further, operations of the ticket printer 171 may be controlled and a ticket with a barcode may be issued on which a value stored in the number-of-payouts storage area is recorded. After the processing has been conducted, the processing is shifted to step S12.

<Coin-Insertion/Start-Check Processing>

Figure 8:
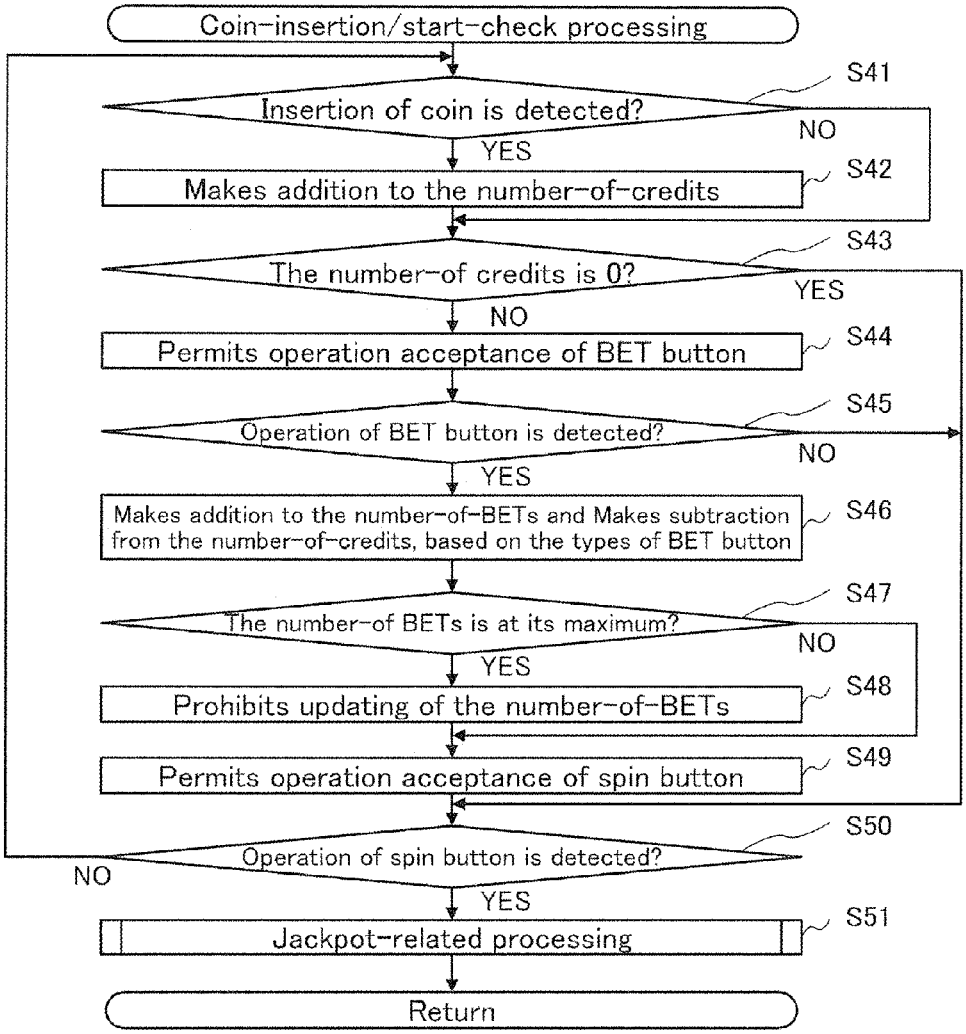
FIG. 8 is a view illustrating a flowchart of coin-insertion/start-check processing for the gaming machine.

Next, with reference to FIG. 8, coin-insertion/start-check processing is described. FIG. 8 is a view illustrating a flowchart of the coin-insertion/start-check processing for the gaming machine according to the embodiment of the present invention.

First, the main CPU 71 determines whether or not insertion of a coin has been detected by the coin counter 92C (step S41). When determining that the insertion of a coin has been detected by the coin counter 92C, the main CPU 71 makes an addition to the value stored in the number-of-credits storage area (step S42). It is to be noted that, in addition to the insertion of a coin, the main CPU 71 may determine whether or not insertion of a bill has been detected by the bill validator 115, and when determining that the insertion of a bill has been detected, the main CPU 71 may add a value according to the bill to the value stored in the number-of-credits storage area.

After step S42 or when determining in step S41 that the insertion of a coin has not been detected, the main CPU 71 determines whether or not the value stored in the number-of-credits storage area is zero (step S43). When the main CPU 71 determines that the value stored in the number-of-credits storage area is not zero, the main CPU 71 permits operation acceptance of the BET buttons (step S44).

Next, the main CPU 71 determines whether or not operation of any of the BET buttons has been detected (step S45). When the main CPU 71 determines that the BET switch has detected press of the BET button by the player, the main CPU 71 makes an addition to a value stored in a number-of-BETs storage area provided in the RAM 73 and makes a subtraction from the value stored in the number-of-credits storage area, based on the type of the BET button (step S46).

The main CPU 71 then determines whether or not the value stored in the number-of-BETs storage area is at its maximum (step S47). When the main CPU 71 determines that the value stored in the number-of-BETs storage area is at its maximum, the main CPU 71 prohibits updating of the value stored in the number-of-BETs storage area (step S48). After step S48 or when determining in step S47 that the value stored in the number-of-BETs storage area is not at its maximum, the main CPU 71 permits operation acceptance of the spin button (step S49).

After step S49 or when determining in step S45 that the operation of any of the BET buttons has not been detected, or when determining in step S43 that the value stored in the number-of-credits storage area is zero, the main CPU 71 determines whether or not operation of the spin button has been detected (step S50). When the main CPU 71 determines that the operation of the spin button has not been detected, the processing is shifted to step S41.

When the main CPU 71 determines that the operation of the spin button has been detected, the main CPU 71 conducts jackpot-related processing which is described later with reference to FIG. 9 (step S51). In the processing, the amount to be accumulated (the amount of a contribution) to the jackpot amount is calculated, added to the jackpot amount, and stored in the jackpot amount storage area. After the processing has been conducted, the coin-insertion/start-check processing is completed.

<Jackpot-Related Processing>

Figure 9:
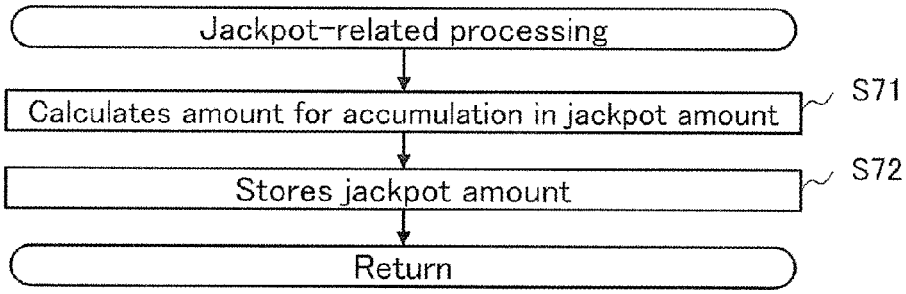
FIG. 9 is a view illustrating a flowchart of jackpot-related processing for the gaming machine.

Now, with reference to FIG. 9, the jackpot-related processing is described. FIG. 9 is a view illustrating a flowchart of the jackpot-related processing for the gaming machine according to the embodiment of the present invention.

First, the main CPU 71 calculates the amount for accumulation in the jackpot amount (step S71). The main CPU 71 obtains the product of the value stored in the number-of-BETs storage area and a preset accumulation ratio, so that the amount for accumulation in the jackpot amount is calculated.

Next, the main CPU 71 adds the amount for accumulation in the jackpot amount and stores the sum in the jackpot amount storage area (step S72). After this processing has been conducted, the jackpot-related processing is completed. It should be noted that, if the jackpot is a network type, the main CPU 71 transmits the amount for accumulation in the jackpot amount to the external control device 200 and the external control device 200 updates the jackpot amount upon receipt of the amount for accumulation in the jackpot amount.

<Symbol Lottery Processing>

Figure 10:
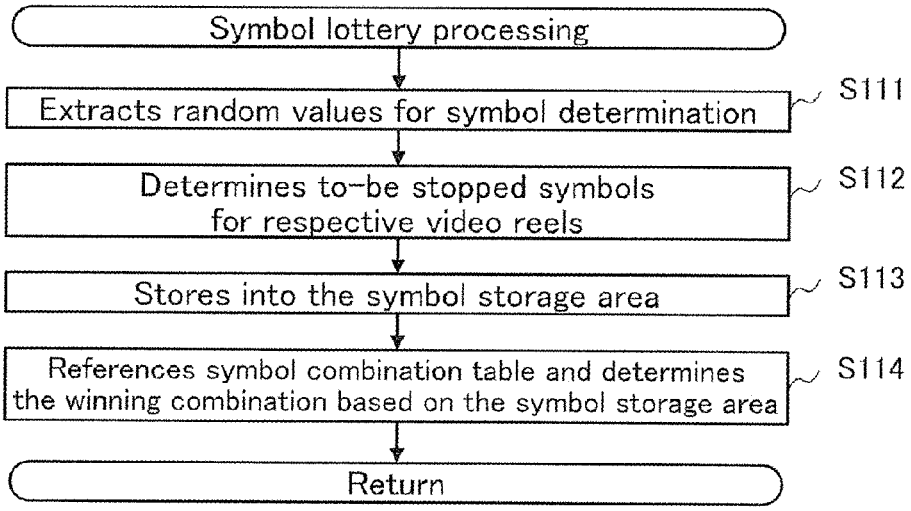
FIG. 10 is a view illustrating a flowchart of symbol lottery processing for the gaming machine.

Next, with reference to FIG. 10, the symbol lottery processing is described. FIG. 10 is a view illustrating a flowchart of the symbol lottery processing for the gaming machine according to the embodiment of the present invention.

First, the main CPU 71 extracts random values for symbol determination (step 111). The main CPU 71 then determines to-be stopped symbols for the respective video reels 3 by lottery (step S112). The main CPU 71 holds a lottery for each video reel 3, and determines any one of the 22 symbols (code numbers from "00" to "21") as a to-be stopped symbol. At this time, each of the 22 symbols (code numbers from "00" to "21") is determined at an equal probability (i.e. 1/22).

The main CPU 71 then stores the determined to-be stopped symbols for the respective video reels 3 into a symbol storage area provided in the RAM 73 (step S113). Next, the main CPU 71 references the symbol combination table (FIG. 6) and determines a winning combination based on the symbol storage area (step S114). The main CPU 71 determines whether or not the combination of symbols to be displayed along the winning line by the respective video reels 3 matches any of the combinations of symbols specified by the symbol combination table, and determines the winning combination. After the processing has been conducted, the symbol lottery processing is completed.

<Symbol Display Control Processing>

Figure 11:
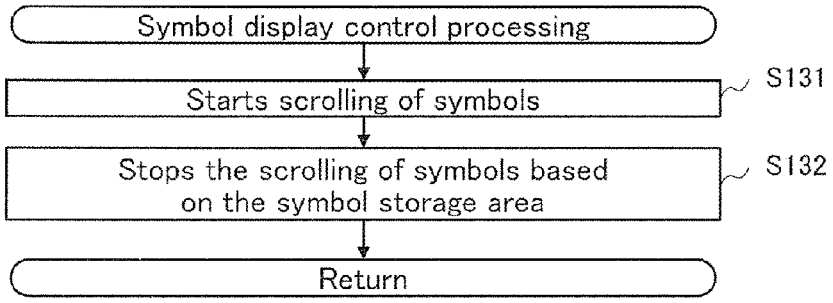
FIG. 11 is a view illustrating a flowchart of symbol display control processing for the gaming machine.

Next, with reference to FIG. 11, the symbol display control processing is described. FIG. 11 is a view illustrating a flowchart of the symbol display control processing for the gaming machine according to the embodiment of the present invention.

First, the main CPU 71 starts scrolling of the symbol arrays of the respective video reels 3 that are displayed to the symbol display region 4 of the lower image display panel 141 (step S131). The main CPU 71 then stops the scrolling of the symbol arrays of the respective video reels 3, based on the aforementioned symbol storage area (step S132). After the processing has been conducted, the symbol display control processing is completed.

<Number-of-Payouts Determination Processing>

Figure 12:
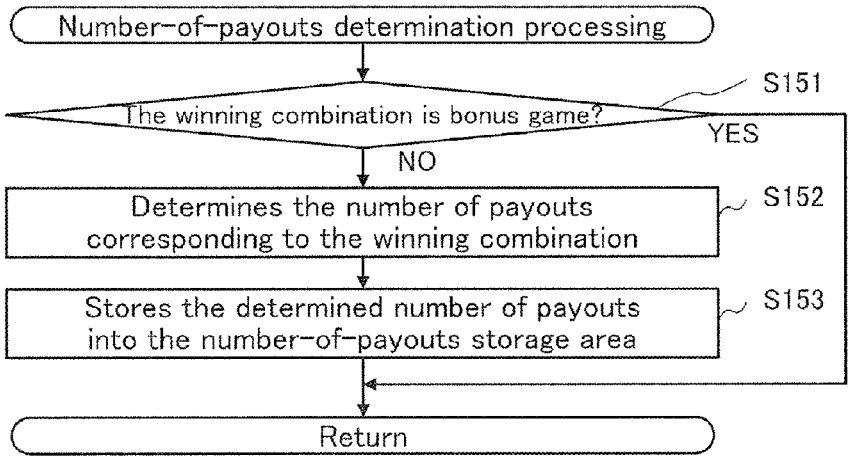
FIG. 12 is a view illustrating a flowchart of number-of-payouts determination processing for the gaming machine.

Next, with reference to FIG. 12, the number-of-payouts determination processing is described. FIG. 12 is a view illustrating a flowchart of the number-of-payouts determination processing for the gaming machine according to the embodiment of the present invention.

The main CPU 71 first determines whether or not the winning combination is a bonus game (step S151). When the main CPU 71 determines that the winning combination is not a bonus game, the main CPU 71 determines the number of payouts corresponding to the winning combination (step S152). For example, when the winning combination is "BELL", the main CPU 71 determines "8" as the number of payouts (see FIG. 6). It is to be noted that the main CPU 71 determines "0" as the number of payouts in the case where the game is lost. Next, the main CPU 71 stores the determined number of payouts into the number-of-payouts storage area (step S153). After the processing has been conducted, the number-of-payouts determination processing is completed.

<Bonus Game Processing>

Figure 13:
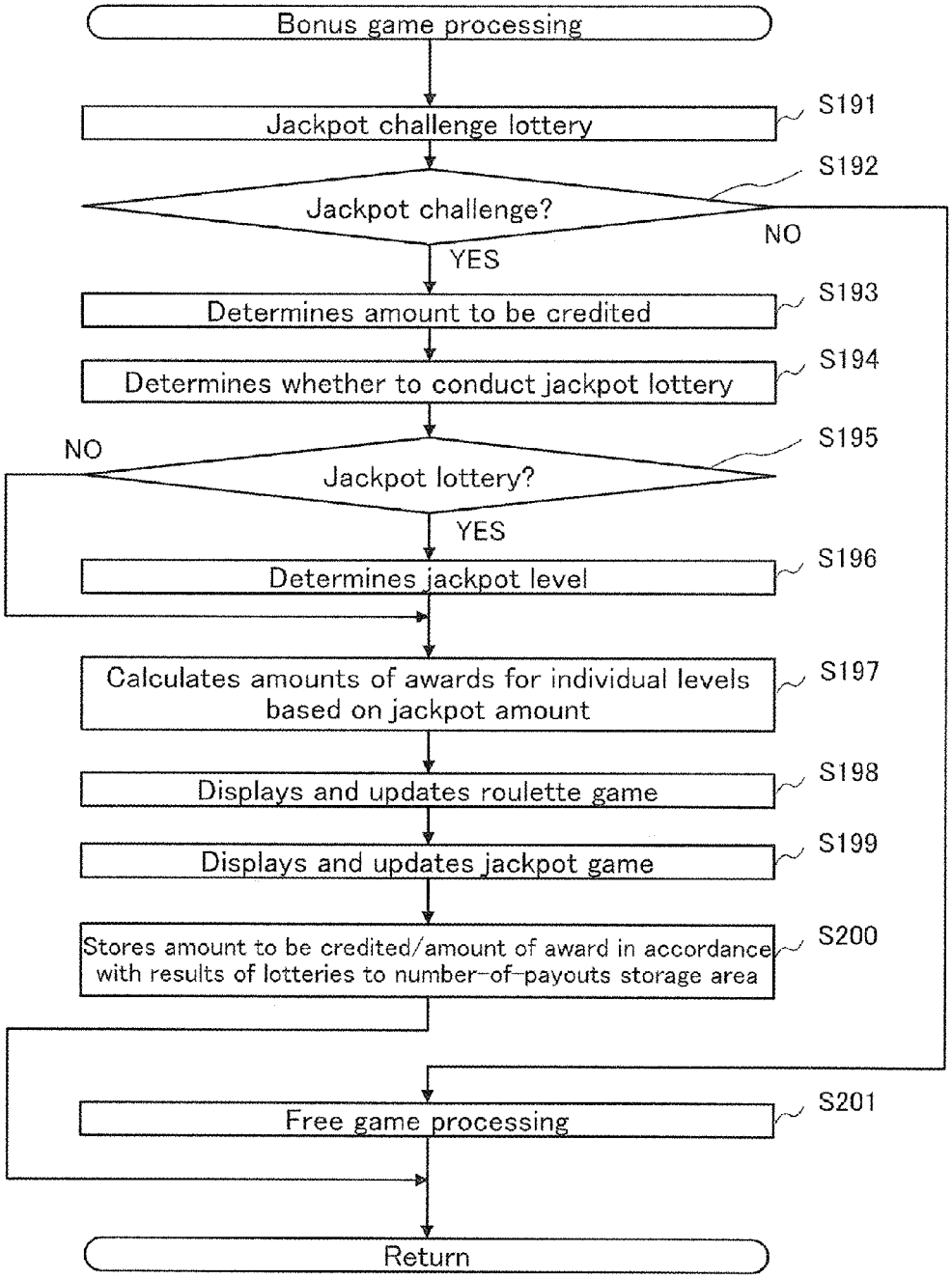
FIG. 13 is a view illustrating a flowchart of bonus game processing for the gaming machine.

Next, with reference to FIGS. 13 to 18, the bonus game processing is described. FIG. 13 is a view illustrating a flowchart of the bonus game processing in the gaming machine according to the embodiment of the present invention.

The main CPU 71 conducts a lottery for a jackpot challenge (step S191). The main CPU 71 extracts a random value for jackpot challenge lottery and determines the game to be conducted from the random value for jackpot challenge lottery and the jackpot challenge lottery table illustrated in FIG. 14. Specifically, one of the free games A to D or the jackpot challenge is determined by lottery. For each game in the jackpot challenge lottery table, the winning probability is assigned to be equal, at 1/5.

Such a probability can be assigned, for example, in a roulette game in which five games of the free games A to D and the jackpot challenge are associated with five different substantially equally-sized sectorial indication sections of the roulette wheel and how the roulette finally stops (which indication section stops at a specified position to win the associated game) is determined. Like this case, if the multiple indication sections have substantially the same size, winning the games associated with those indication sections at equal probabilities may be recommended since it is considered natural. In such an occasion, assignment of equal winning probabilities to the games can eliminate the unnaturalness of the game process and the player's distrust.

Next, the main CPU 71 determines whether or not to win the jackpot challenge (step S192). At this step, if the main CPU 71 determines to win one of the free games A to D, it proceeds to free game processing (step S201). A free game is, for example, a game that conducts a predetermined number of lotteries for determining the aforementioned to-be-stopped symbols without consuming coins.

If the main CPU 71 determines to win the jackpot challenge at step S192, it determines the amount to be credited (step S193). The main CPU 71 extracts a random value for credit determination, determines one of the integers of 18 to 22 from this random value for credit determination and a credit lottery table illustrated in FIG. 15, and calculates the amount to be credited based on the determined numerical value. According to the credit lottery table, the probability to select either a value "19" or "20" is 2/7, which is twice as much as the probability to select one of the other values.

In the case where the value determined by lottery from the credit lottery table is "20", the amount to be credited can be determined to be "200", which is obtained by multiplying the value "20" by the number of BETs "10".

Next, the main CPU 71 extracts a random value for jackpot determination and conducts a lottery using this random value for jackpot determination and the jackpot lottery table illustrated in FIG. 16 (step S194). This lottery leads to one of two different lottery results, either "Credit" or "Jackpot+Credit". In the jackpot lottery table, the probability to select "Credit" may be set at (X−1×the number of BETs)/X and the probability to select "Jackpot+Credit" may be set at (1×the number of BETs)/X.

In these formulae, X=500×jackpot initial credit (GRAND)/50000; the jackpot initial credit (GRAND) represents the initial credit for the highest level of jackpot (later-described "GRAND"); and the initial credit represents a reset value for the award after winning in the jackpot.

Because of the above-described probability assignment, the winning probability in this lottery varies with the number of BETs; for example, the winning probability of Jackpot+Credit is higher when the number of BETs is greater. The winning probability further varies with the jackpot initial credit (GRAND); for example, the winning probability of Credit is higher when the jackpot initial credit (GRAND) is more.

Next, the main CPU 71 determines whether or not to conduct a jackpot lottery, namely whether or not Jackpot+Credit has been won (step S195). If the determination is that Credit has been won, the main CPU 71 proceeds to step S197.

If the main CPU 71 determines that Jackpot+Credit has been won at step S195, the main CPU 71 determines the level of the jackpot to be won (step S196). In the present embodiment, there are provided four jackpot levels, "MINI", "MINOR", "MAJOR", and "GRAND" in order from the lowest level that provides the lowest amount of award to the highest.

At this step, the main CPU 71 extracts a random value for jackpot level determination and determines one of the levels "MINI" to "GRAND" from this random value for jackpot level determination and a jackpot level lottery table illustrated in FIG. 17. In the jackpot level lottery table, the probability to select the level "MINI" may be 43/100, the probability to select the level "MINOR" may be 42/100, the probability to select the level "MAJOR" may be 11/100, and the probability to select the level "GRAND" may be 4/100; a lower winning probability is assigned to a higher level that provides the player with more benefit.

Next, at step S197, the main CPU 71 calculates the amounts of awards for the individual jackpot levels ("MINI" to "GRAND") from the jackpot amount stored in the jackpot amount storage area.

The amounts of awards for the individual levels ("MINI" to "GRAND") may be calculated based on the respective jackpot initial credits and increment rates determined for the individual jackpot levels. The jackpot amount stored in the jackpot amount storage area is divided in accordance with the increment rates of the levels and cumulatively added to the awards for the corresponding levels to be the next awards for the levels. If a jackpot lottery results in winning any level of jackpot, the amount of the next award for each level is reset at the initial credit for the level.

That is to say, the jackpot amount is divided in accordance with the increment rates of the individual levels and successively accumulated to the awards of the levels unless winning Jackpot+Credit.

In the case of a network type that shares a jackpot by gaming machines connected in a single or multiple game facilities, the main CPU 71 first notifies the external control device 200 of conductance of a jackpot lottery; upon receipt of the notification, the external control device 200 transmits the latest jackpot amount that has been updated to the gaming machines. At this time, the external control device 200 may determine to pay out a part of the jackpot amount (e.g. 80 percent) and carry over the remaining (e.g. 20 percent) for the next jackpot lottery. Next, the main CPU 71 receives the jackpot amount from the external control device 200 and then calculates the amounts of awards for the individual jackpot levels.

Figure 18:
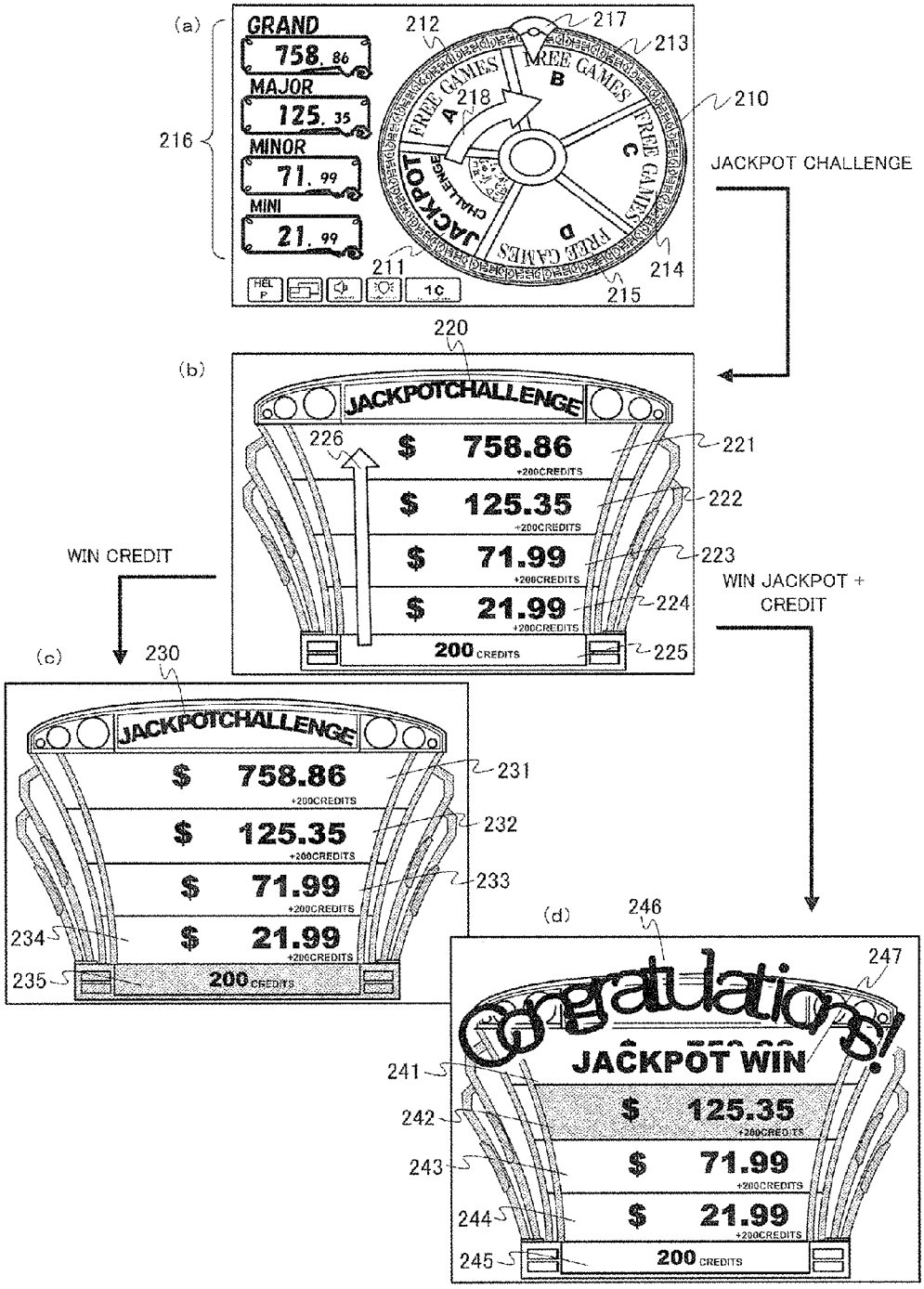
FIG. 18 is a view illustrating image transition in a bonus game.

Next, the main CPU 71 displays a roulette game (an image of a roulette game) on the upper image display panel 131 as a first image of a bonus game, as shown in FIG. 18(*a*). The image includes a roulette wheel 210 including one sectorial section (jackpot challenge section 211) associated with the prize of JACKPOT CHALLENGE and four sectorial sections (free game sections 212 to 215) associated with the prizes of FREE GAMES disposed along the circumferential direction. In this image, an award display region 216 for displaying the amounts of awards for individual jackpot levels ("MINI" to "GRAND") in order.

After a certain time has elapsed, the main CPU 71 displays an image in which the roulette wheel 210 is spinning. Thereafter, it rearranges the roulette wheel 210 on the display so that the predetermined section of the roulette wheel 210 (in this case, the jackpot challenge section 211) will stop at the top in accordance with the result of the lottery at step S191 (step S198). FIG. 18(*a*) shows this situation. The roulette wheel 210 rotates clockwise as indicated by an arrow 218 and the jackpot challenge section 211 stops at the position indicated by an inverted triangle pointer 217 disposed on the upper side of the roulette wheel 210. The stopped situation like this indicates that a jackpot challenge has been won in the roulette game.

In this example, the roulette wheel 210 is rotated after a certain time has elapsed and then stopped to be rearranged on the display; however, the rotation or stop of the roulette wheel 210 may be started by an operation (such as an operation of the BET button, the spin button, or the touch panel) by the player.

If the jackpot challenge section 211 is stopped at the pointer 217 in the display of a roulette game (if the jackpot challenge is won), the main CPU 71 changes the roulette game displayed on the upper image display panel 131 into a jackpot game (an image of a jackpot game) as shown in FIG. 18(*b*). The image of the jackpot game of FIG. 18(*b*) shows the amounts of awards which are correspondingly associated with the prizes of the jackpot in substantially rectangular indication sections (221 to 224). In the lowermost rectangular indication section 225, the amount to be credited for the credit is displayed.

The amount to be credited is an amount obtained by multiplying the number determined by lottery from the credit lottery table by the number of BETs or a predetermined value; for example, the amount "200" is indicated, which has been obtained by multiplying the value "20" determined by lottery from the credit lottery table by the number of BETs "10" as described above.

After a certain time has elapsed, the main CPU 71 may light up or blink the indication sections (221 to 224) associated with the jackpot levels and the indication section 225 associated with the credit in order indicated by the arrow 226, for example. Then, the main CPU 71 highlights one of the indication sections (221 to 225) in accordance with the results of the lotteries at steps S194 and S196 (step S199). In this example, the main CPU 71 controls the display so that the image of the jackpot game changes after a certain time has elapsed, but it may control the display so that the image changes in response to an operation (such as the operation of the BET button, the spin button, the tough panel, or the like) by the player.

For example, if Credit is won at step S194, the main CPU 71 highlights the indication section 235 corresponding to Credit in the image of a jackpot game by lighting up or blinking to indicate the winning only Credit, as illustrated in FIG. 18(*c*). Additional notification may be made by sound outputted from the speaker, or the like.

Alternatively, if Jackpot+Credit is won at step S194, the indication section corresponding to the jackpot level (one of "MINI" to "GRAND") drawn by the further lottery at step S196 is highlighted by lighting or blinking. For example in FIG. 18(*d*), the indication section 242 corresponding to the level "MAJOR" is highlighted. Additional notification may be made by sound outputted from the speaker, or the like.

Furthermore, as shown in FIG. 18(*d*), a text 246 "Congratulations!" and a text 247 "JACKPOT WIN" indicating the winning Jackpot+Credit are displayed.

Next, the main CPU 71 determines the amount to be credited plus the amount of award to be the amount of payout in accordance with the results of lotteries at steps S194 and S196 and stores the amount of payout to the number-of-payouts storage area (step S200). In the case of winning Credit at step S194, the amount of to be credited determined at step S193 is determined to be the amount of payout to the player and stored to the number-of-payouts storage area. In the other case of winning Jackpot+Credit at step S194, the amount to be credited determined at step S193 is added to the amount of award for to the jackpot level determined at step S196 and their sum is determined to be the amount of payout to the player and stored to the number-of-payouts storage area.

As described above, the probabilities to win the different games are assigned to be equal in a roulette game. Accordingly, if an appropriate amount of payout has been kept by assigning a low probability to proceed to the jackpot game, the equal winning probability assignment increases the number of jackpot games and further, increases the amount of payout. The embodiment of the present invention, however, provides a further lottery for Credit or Jackpot+Credit (the second lottery) in a jackpot game, and if Jackpot+Credit is won, provides a still further lottery to draw a level of jackpot (one of "MINI" to "GRAND") (the third lottery), achieving adjustment of the total amount of payout within an appropriate range.

In the present embodiment, when a bonus game trigger is established and a bonus game is started, a lottery is conducted to draw whether to perform the jackpot challenge processing or the free game processing. After the completion of the processing, payout processing is conducted to complete one bonus game. However, the bonus game processing may be conducted successively.

For example, the main CPU 71 may extract a random value for bonus game determination to determine the number of bonus games such as "50", "70", or "100" by lottery.

The present embodiment is configured to, as illustrated in FIGS. 8 and 9 as the jackpot-related processing, calculate the amount for accumulation in the jackpot amount upon detection of an operation of the spin button, add the amount to the jackpot amount, store the sum in the jackpot amount storage area (steps S71 and S72 in FIG. 9), and, as illustrated in FIG. 13, take out some jackpot amount from the jackpot amount storage area after determination of the jackpot level (step S197). However, these process steps may be designed to be conducted at various occasions depending on the specification.

Further, the present embodiment is configured to, after starting bonus game processing, conduct a jackpot challenge lottery (step S191), determine the amount to be credited (step S192), conduct a jackpot lottery (step S194), and conduct a jackpot level lottery (step S196), and after all of these lotteries are completed, display a roulette game and change the display to a jackpot game. However, these games may also be designed to be displayed at various occasions depending on the specification as far as data required for the display has been acquired.

What is claimed is:

1. A gaming machine comprising:

a value-input mechanism by which value to be bet can be added to the gaming machine;

a validator;

an award payout mechanism that pays out gaming media;

a first display for displaying a first game which provides a game result based on a plurality of rearranged symbols;

a second display for displaying a second game and a third game; and a controller, which controls the first display and the second display; which, via the validator, identifies gaming media that has been added to the gaming machine; which establishes a credit balance for a player based at least in part on gaming media that has been added to the gaming machine; and which, as a result of the player having bet gaming media, executes the following processing of (1-1) to (1-6):

(1-1) displaying the second game on the second display to show indication sections correspondingly associated with lottery results of a first lottery to have a substantially equal size in a case where a predetermined number or more of a predetermined type of symbols are rearranged along a winning line on the first display as a result of the first game;

(1-2) conducting the first lottery in which all probabilities to draw the lottery results are assigned to be equal;

(1-3) displaying the third game on the second display in a case where, after the processing of (1-2), the first lottery results in a predetermined lottery result;

(1-4) determining an amount of first payout to be included in a benefit provided to the player in the third game;

(1-5) conducting, after the processing of (1-2), a second lottery in which probabilities to draw lottery results are assigned to be different from one another and the lottery results include a first result for including the first payout in the benefit and a second result for including the first payout and second payout in the benefit; and (1-6) determining an amount of the second payout to be included in the benefit provided to the player by conducting a third lottery in the third game, wherein the third lottery is conducted in the third game in a case where the second lottery results in the second result, and the third lottery is not conducted in the third game in a case where the second lottery results in the first result, wherein the third game is a jackpot game, wherein the second result includes a plurality of jackpot levels, wherein the probabilities to draw lottery results in the second lottery are assigned so as to vary depending on a value of an initial credit for a specified jackpot level among the plurality of jackpot levels, the initial credit representing a reset value for an award after winning in the specified jackpot level, wherein the amount of the second payout is an amount obtained by accumulating a predetermined percentage of an amount corresponding to a number of BETs specified by the player when the jackpot game is repeated, and wherein the probabilities to draw lottery results in the second lottery are assigned in such a manner that the probability to draw the first result is higher when the amount of initial credit is larger.

2. A gaming machine according to claim 1, wherein the probabilities to draw lottery results in the second lottery are assigned so as to vary in accordance with the number of BETs specified by the player.

3. A gaming machine according to claim 2, wherein the probabilities to draw lottery results in the second lottery are assigned in such a manner that the probability to draw the second result is higher when the number of BETs is greater.

4. A gaming machine according to claim 2, wherein the processing of (1-5) includes the following processing of (1-5-1):

(1-5-1) determining the amount of the first payout based on a value determined by a fourth lottery and the number of BETs.

5. A gaming machine comprising:

a value-input mechanism by which value to be bet can be added to the gaming machine;

a validator;

an award payout mechanism that pays out gaming media;

a first display for displaying a first game which provides a game result based on a plurality of rearranged symbols;

a second display for displaying a second game and a third game; and a controller, which controls the first display and the second display; which, via the validator, identifies gaming media that has been added to the gaming machine; which establishes a credit balance for a player based at least in part on gaming media that has been added to the gaming machine; and which, as a result of the player having bet gaming media, executes the following processing of (1-1) to (1-6):

(1-1) displaying the second game on the second display to show indication sections correspondingly associated with lottery results of a first lottery to have a substantially equal size in a case where a predetermined number or more of a predetermined type of symbols are rearranged along a winning line on the first display as a result of the first game;

(1-2) conducting the first lottery in which all probabilities to draw the lottery results are assigned to be equal;

(1-3) displaying the third game on the second display in a case where, after the processing of (1-2), the first lottery results in a predetermined lottery result;

(1-4) conducting, after the processing of (1-2), a second lottery in which probabilities to draw lottery results are assigned to be different from one another;

(1-5) determining an amount of first payout to be included in a benefit provided to the player in a case where the second lottery results in a first result or a second result; and (1-6) determining an amount of second payout for a lottery result of a third lottery to be included in the benefit provided to the player in a case where the second lottery results in the second result, wherein the third game is a jackpot game, wherein the second result includes a plurality of jackpot levels, wherein the probabilities to draw lottery results in the second lottery are assigned so as to vary depending on a value of an initial credit for a specified jackpot level among the plurality of jackpot levels, the initial credit representing a reset value for an award after winning in the specified jackpot level, and wherein the amount of the second payout is an amount obtained by accumulating a predetermined percentage of an amount corresponding to a number of BETs specified by the player when the jackpot game is repeated.

* * * * *